US012553690B2

(12) United States Patent
Kim

(10) Patent No.: US 12,553,690 B2
(45) Date of Patent: Feb. 17, 2026

(54) SHELL SIMULATED SHOOTING SIMULATION SYSTEM

(71) Applicant: OPTIMUS SYSTEM CO., LTD., Yongin-si (KR)

(72) Inventor: Nam Hyuk Kim, Gyeonggi-do (KR)

(73) Assignee: OPTIMUS SYSTEM CO., LTD., Yongin-si (KR)

( * ) Notice: Subject to any disclaimer, the term of this patent is extended or adjusted under 35 U.S.C. 154(b) by 177 days.

(21) Appl. No.: 18/521,363

(22) Filed: Nov. 28, 2023

(65) Prior Publication Data

US 2024/0410675 A1 Dec. 12, 2024

(30) Foreign Application Priority Data

Jun. 8, 2023 (KR) ..... 10-2023-0073703

(51) Int. Cl.
*F41G 3/26* (2006.01)

(52) U.S. Cl.
CPC ..... *F41G 3/26* (2013.01)

(58) Field of Classification Search
CPC ..... F41G 3/26
See application file for complete search history.

(56) References Cited

FOREIGN PATENT DOCUMENTS

| | | | |
|---|---|---|---|
| KR | 1020070111742 | B1 | 8/2009 |
| KR | 1020160134788 | B1 | 11/2018 |
| KR | 1020190124384 | A | 10/2019 |
| KR | 1020180093580 | B1 | 7/2020 |
| KR | 1020210169481 | B1 | 5/2024 |

*Primary Examiner* — Robert P Bullington
(74) *Attorney, Agent, or Firm* — STIP Law Group, LLC

(57) ABSTRACT

Disclosed herein is a shell simulated shooting simulation system for performing a shell simulated shooting similar to a live shell shooting includes an execution module loading and aiming a shell to perform a shell simulated shooting, a display module visually displaying shooting of a shell according to loading and aiming through the execution module, and a server module collecting information to visually display a result of the live shell shooting on the display module based on the information on the loading and aiming of the shell of the execution module.

6 Claims, 9 Drawing Sheets

SHELL SIMULATED SHOOTING SIMULATION SYSTEM

CROSS REFERENCE TO RELATED APPLICATION

This application claims the benefit of Korean Patent Application No. 10-2023-0073703, filed on, 2023, entitled "SHELL SIMULATED SHOOTING SIMULATION SYSTEM", which is hereby incorporated by reference in its entirety into this application.

BACKGROUND

Field

The present invention relates to a shell simulated shooting simulation system, and more specifically, to a shell simulated shooting simulation system capable of providing an environment similar to carrying out live shell shooting, thereby increasing the performance and practice effect of training and allowing the results of simulated shooting to be easily visually identified, while preventing accidents by preventing shells from actually being shot.

Description of the Related Art

In order to protect the country, it is important to reinforce military power, and even after military power is strengthened, it is important to continuously train soldiers to prevent emergencies to respond thereto.

In particular, in the case of the Army, which generally shoots a gun using actual ammunition, training may be easily carried out if it is equipped with a live shell shooting range to perform live shooting, but in the case of artillerymen who shoot shells, they may not easily carry out training due to the range of rupture of shells and problems arising from the aftermath of the rupture.

However, in order to solve this problem, simulated shooting training may be conducted using simulated ammunition. However, in the case of simulated ammunition, an environment similar to actual training is created and simulated ammunition is actually shot, and if a deflection angle of gun placement is set incorrectly, private houses may be damaged, and there may be cases where damage actually occurs to private houses.

Due to this problem, live shooting shell training may not be easily performed, and even shell simulated shooting training may result in problems of merely placing a gun barrel.

In order to solve the above problems, various methods have been devised to easily access training situations, while solving the problems caused by shells or simulated ammunition, and a means to solve the problems is required.

SUMMARY

An object of the present invention is to provide an environment similar to carrying out live shell shooting, thereby increasing the performance and practice effect of training and allowing the results of simulated shooting to be easily visually identified, while preventing accidents by preventing shells from actually being shot.

The problems of the present invention are not limited to the problems mentioned above, and other problems not mentioned will be clearly understood by those skilled in the art from the description below.

According to an embodiment of the present invention, there is provided a shell simulated shooting simulation system for performing a shell simulated shooting similar to a live shell shooting including an execution module loading and aiming a shell to perform a shell simulated shooting, a display module visually displaying shooting of a shell according to loading and aiming through the execution module, and a server module collecting information to visually display a result of the live shell shooting on the display module based on the information on the loading and aiming of the shell of the execution module.

The server module may sense environment information and correct the environment information with information from the execution module to provide an environment similar to live shell shooting.

The execution module may include a shell unit adjusting a type, flight distance, and time of the shell to perform shell simulated shooting, a gun barrel unit sensing information from the shell unit, transferring the information of the shell unit to the server module, and adjusting a deflection angle and an elevation angle of shell simulated shooting, and a target unit forming a reference point of the deflection angle of the gun barrel unit in order to establish a shell simulated shooting environment similar to live shell shooting.

The shell unit may include: a selection unit adjusting the type of simulated shooting shell; an explosive adjustment unit adjusting an amount 4 explosives inserted into the shell to adjust the flight distance of the simulated shooting shell; and a fuse insertion unit adjusting a time for the shell to rupture so that the shell is ruptured in the air when the type of simulated shooting shell is selected as a shell that is ruptured in the air, such as a flare, through the selection unit.

The gun barrel unit may have a space formed therein so that the shell unit is inserted therein, and include a shell information unit transferring information of the selection unit, the explosive adjustment unit, and the fuse insertion unit to transmit the information of the shell unit inserted therein to the server module.

The server module may determine a shooting distance of the shell and a rupture location of the shell based on the information transferred through the shell information unit and transfer the shooting distance of the shell and the rupture location of the shell to the display module.

The server module may receive gun placement status information of the gun barrel unit, compare the received information with preset terrain information, and transfer a deflection angle and elevation angle at which the shell is shot to the display module.

The gun barrel unit may include: a deflection angle adjustment unit adjusting the deflection angle based on the target unit; and an elevation angle adjustment unit adjusting a flight distance according to an altitude at which the shell is shot or adjusting an elevation angle to prevent the shell from being shot at an obstacle.

The display module may display and provide a shell simulated shooting environment similar to live shell shooting based on a first-person perspective.

The server module may include an illuminance sensor so that a screen is displayed on the display module similar to live shell shooting, to adjust illuminance of the display module based on the information recognized by the illuminance sensor.

The shell simulated shooting simulation system of the present invention may provide an environment similar to carrying out live shell shooting, thereby increasing the performance and practice effect of training and allowing the results of simulated shooting to be easily visually identified, while preventing accidents by preventing shells from actually being shot.

The effects of the present invention are not limited to the effects mentioned above, and other effects not mentioned will be clearly understood by those skilled in the art from the description of the claims.

BRIEF DESCRIPTION OF THE DRAWINGS

The aforementioned summary as well as the detailed description of the embodiments of the present application described below may be better understood when read in conjunction with the accompanying drawings.

Embodiments are shown in the drawings for the purpose of illustrating the invention.

However, it should be understood that the present application is not limited to the exact placement and means shown.

Figure 1:
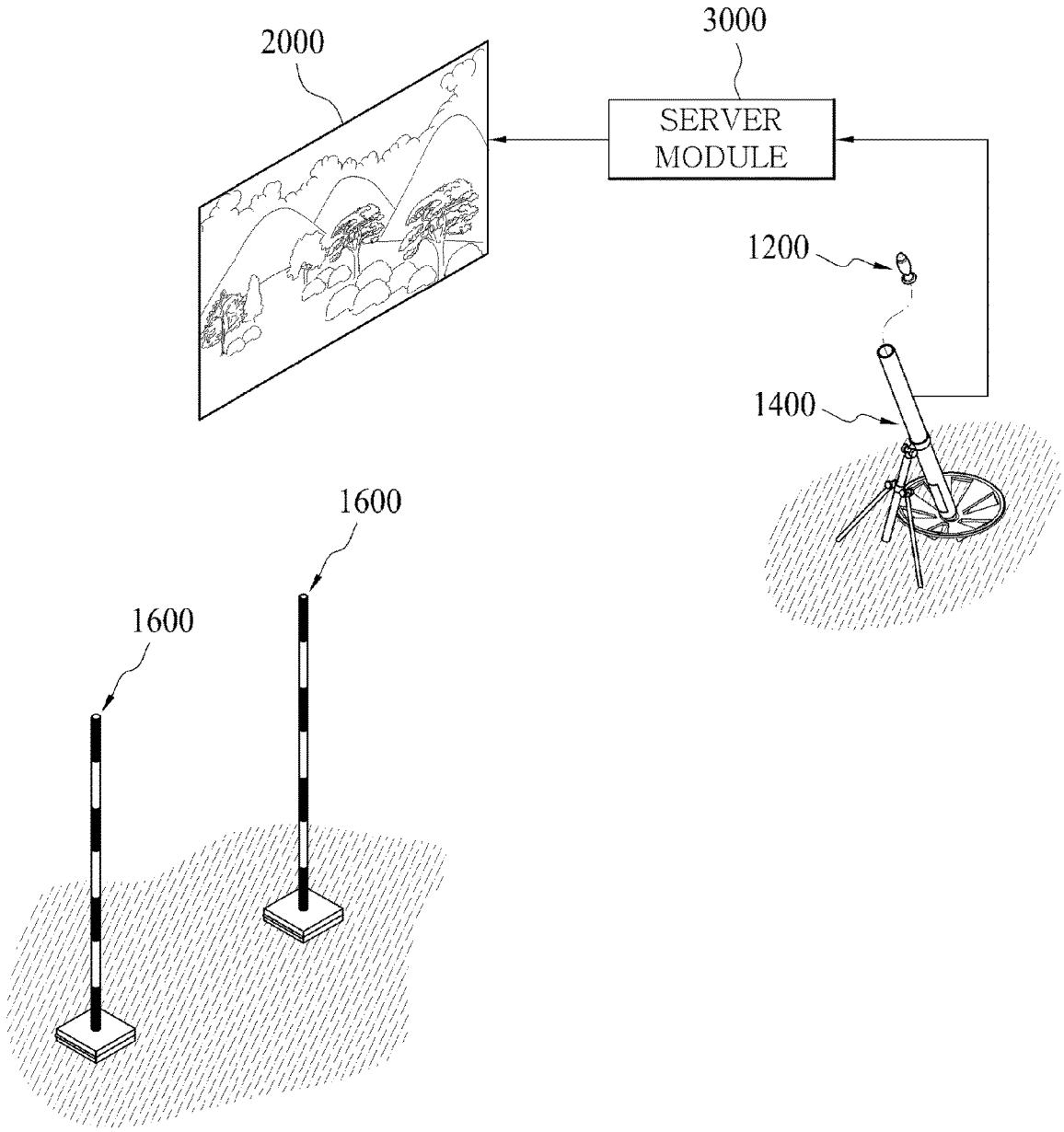
Figure 2:
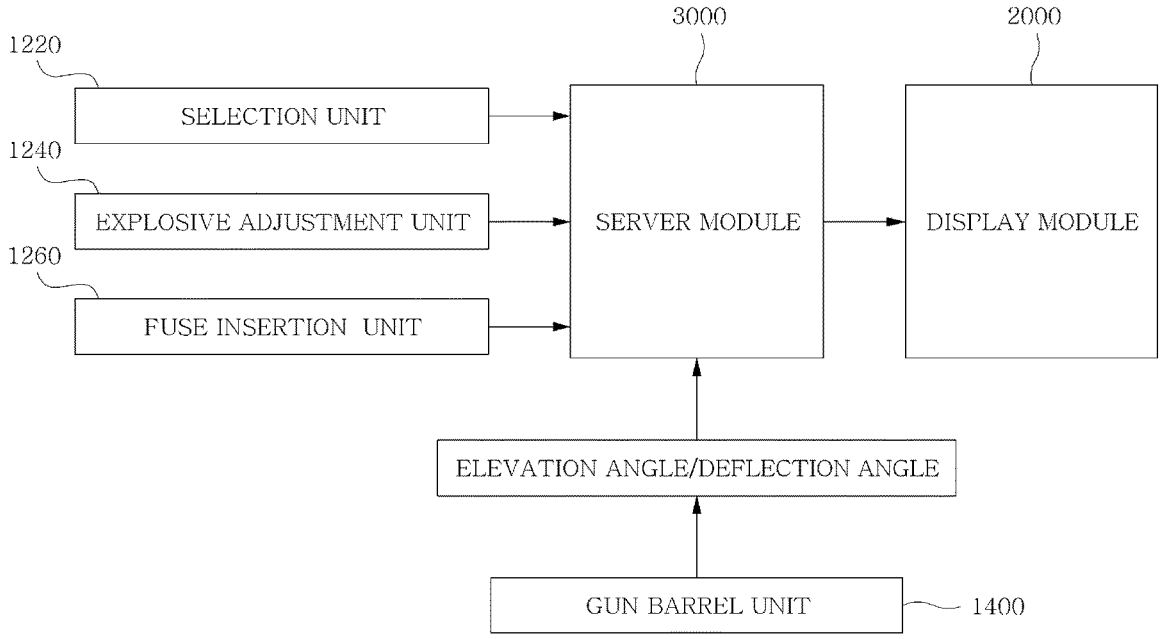
Figure 3:
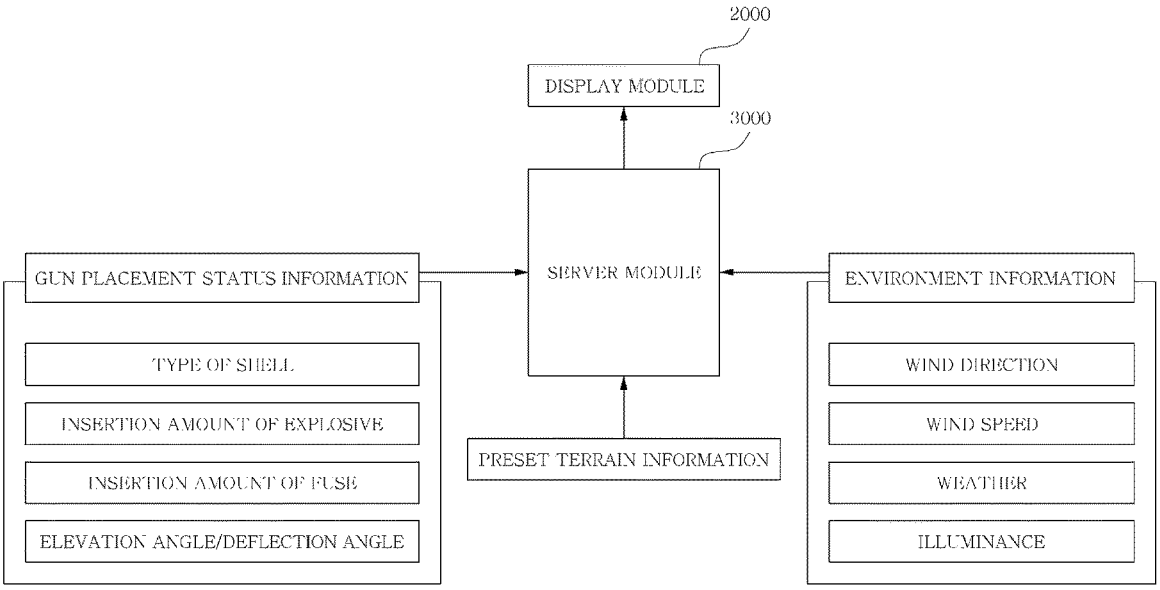
Figure 4:
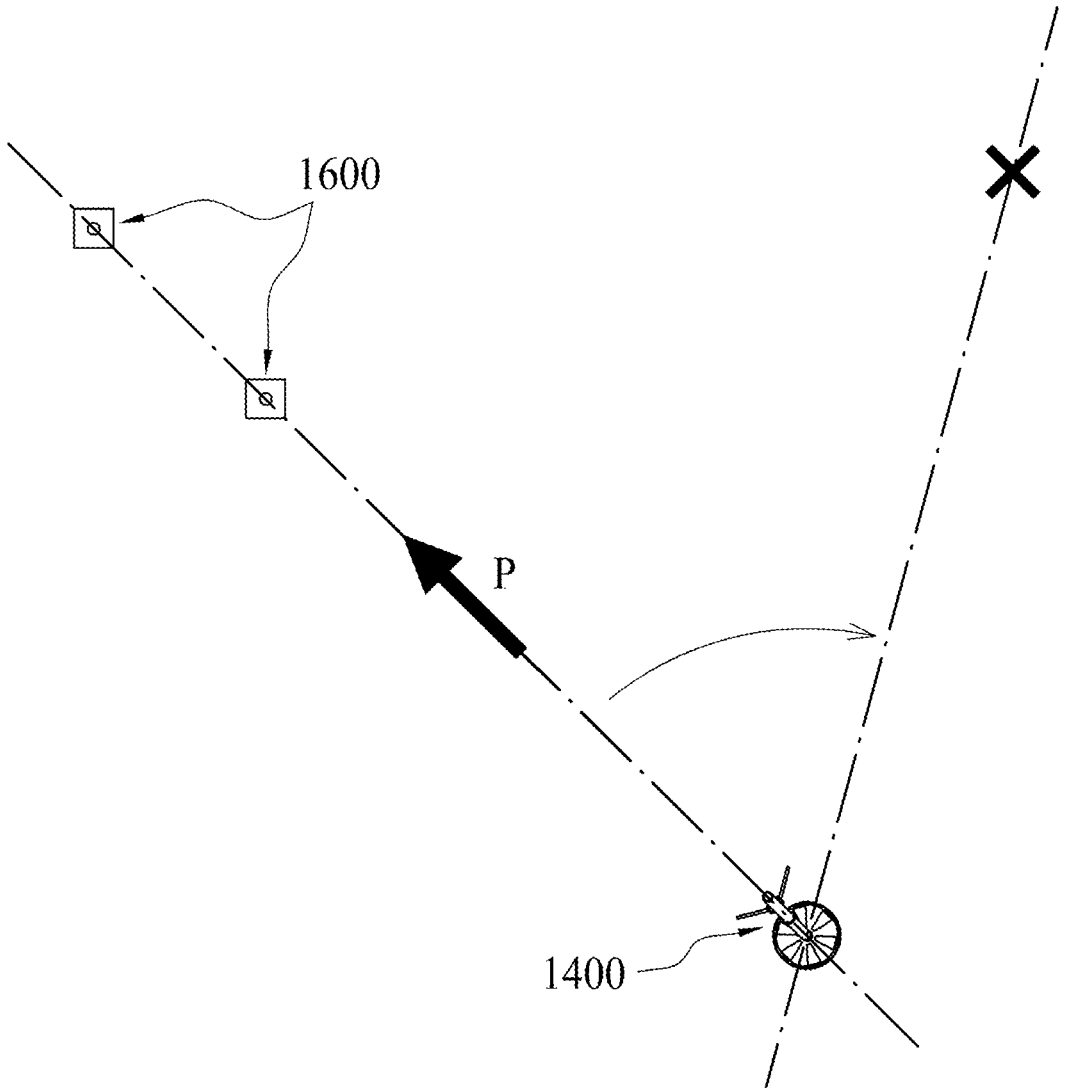
Figure 5:
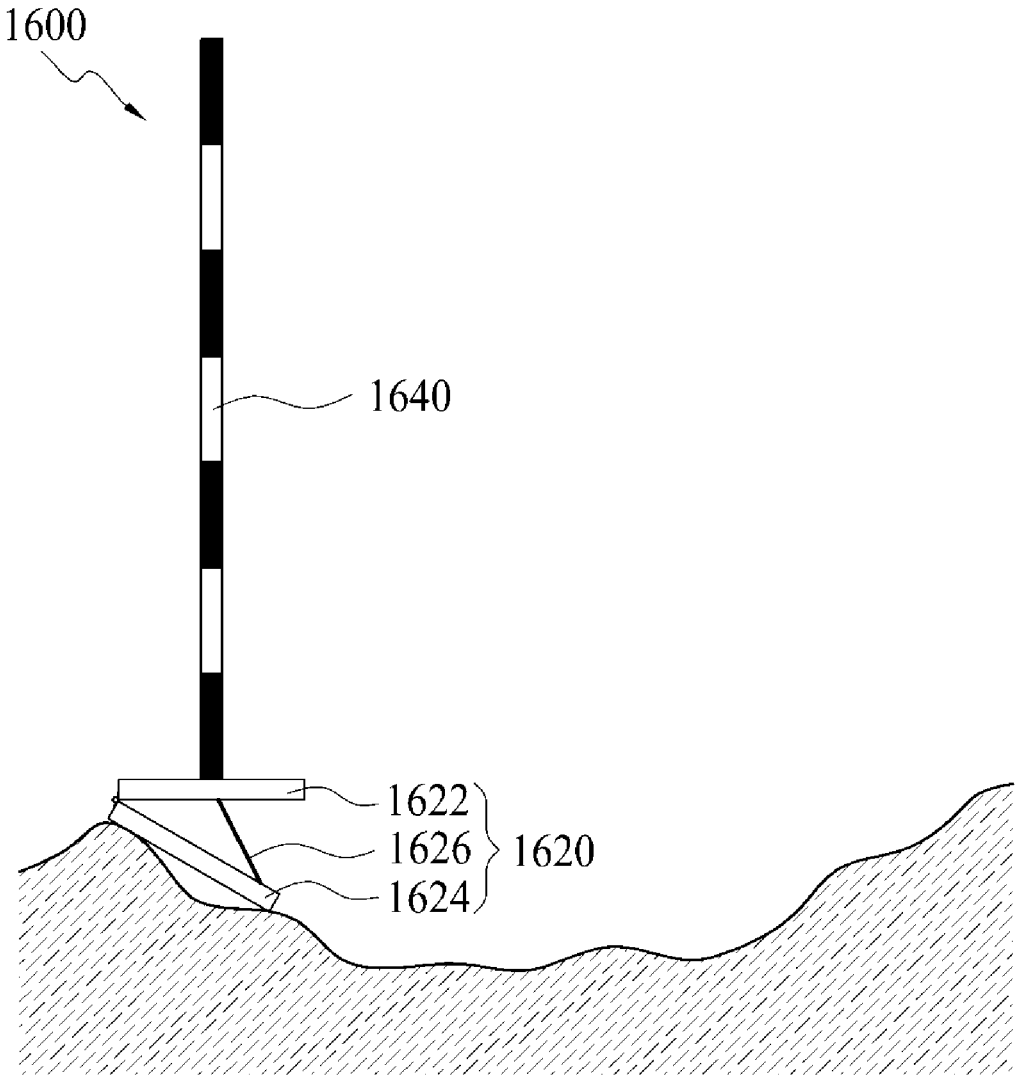
Figure 6:
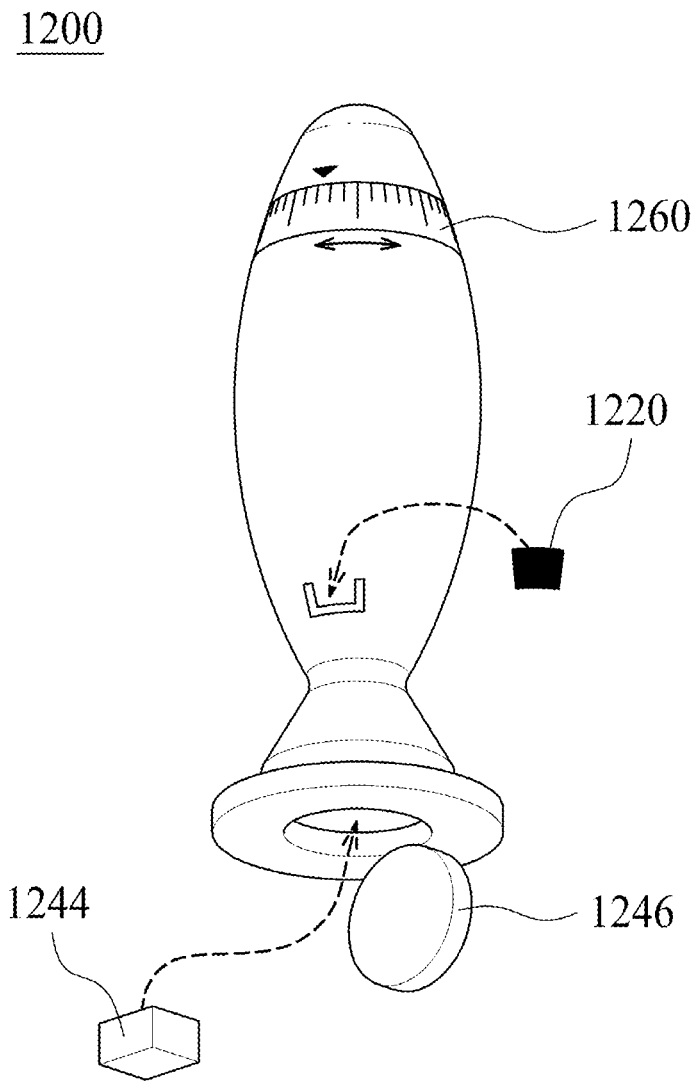
Figure 7:
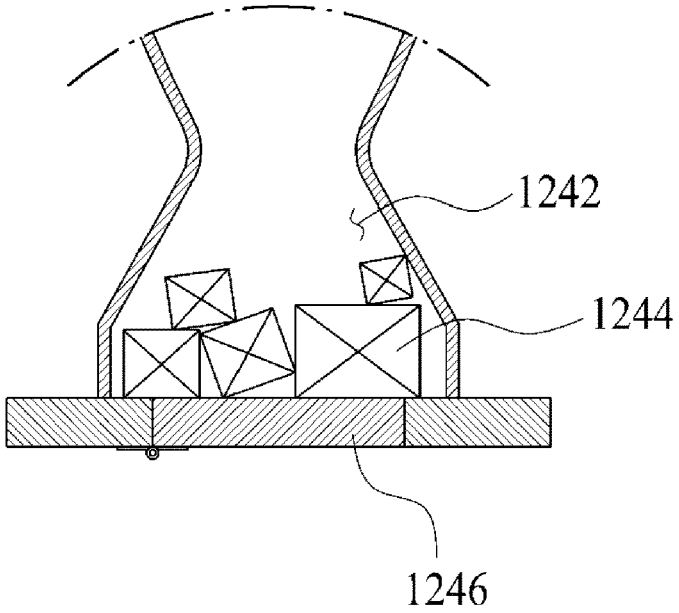
Figure 8:
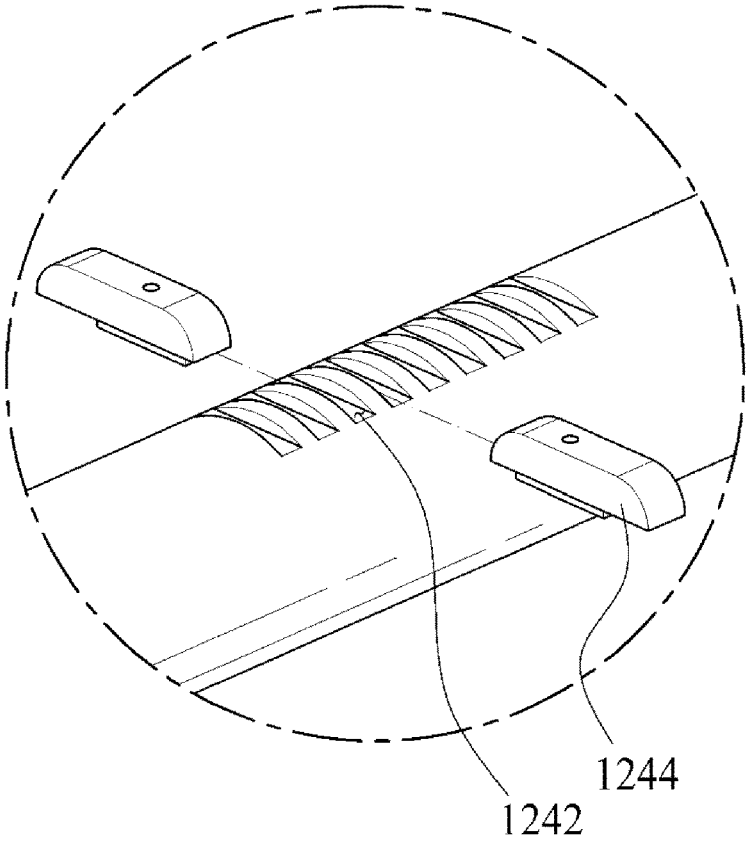
Figure 9:
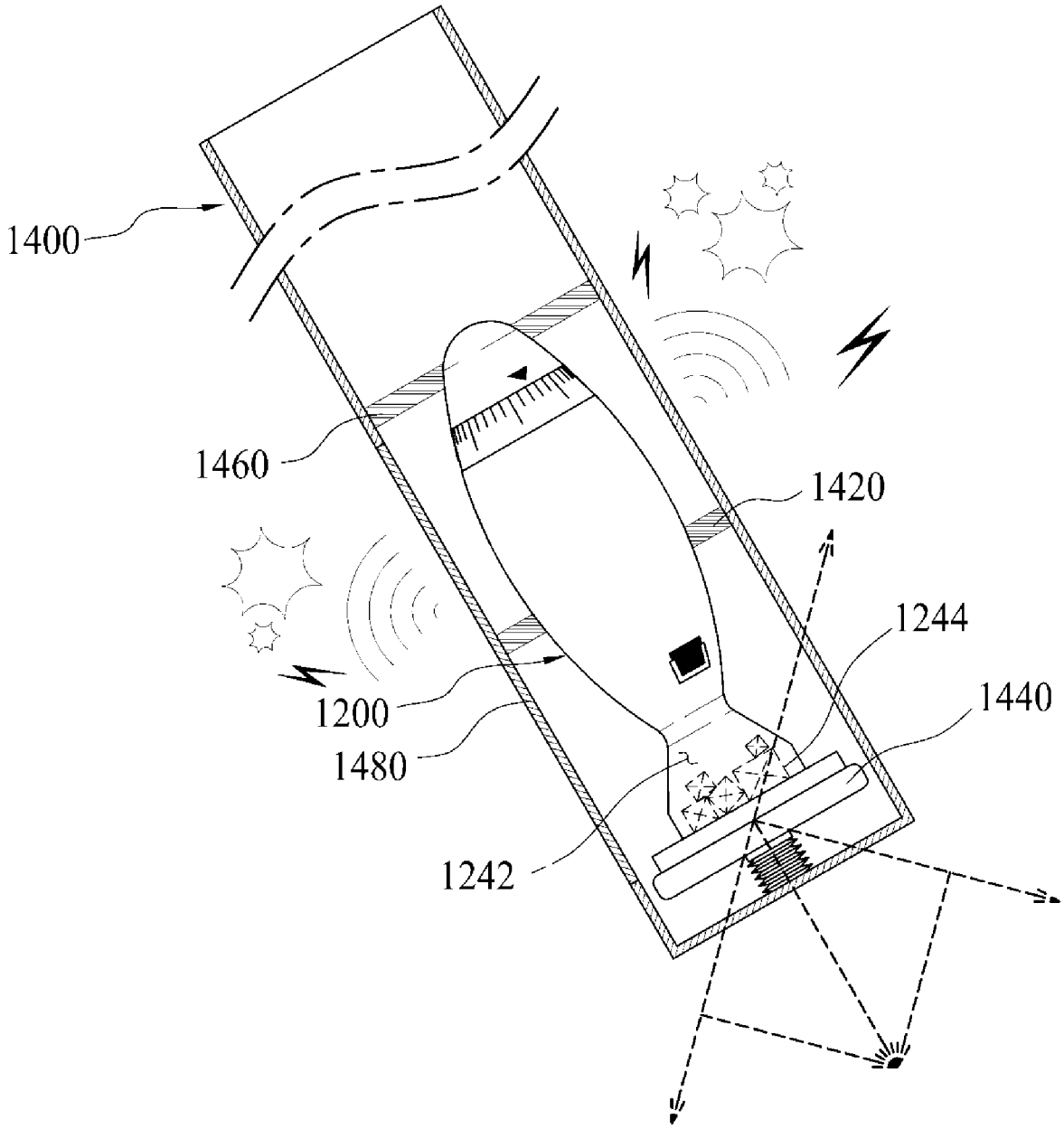
Figure 10:
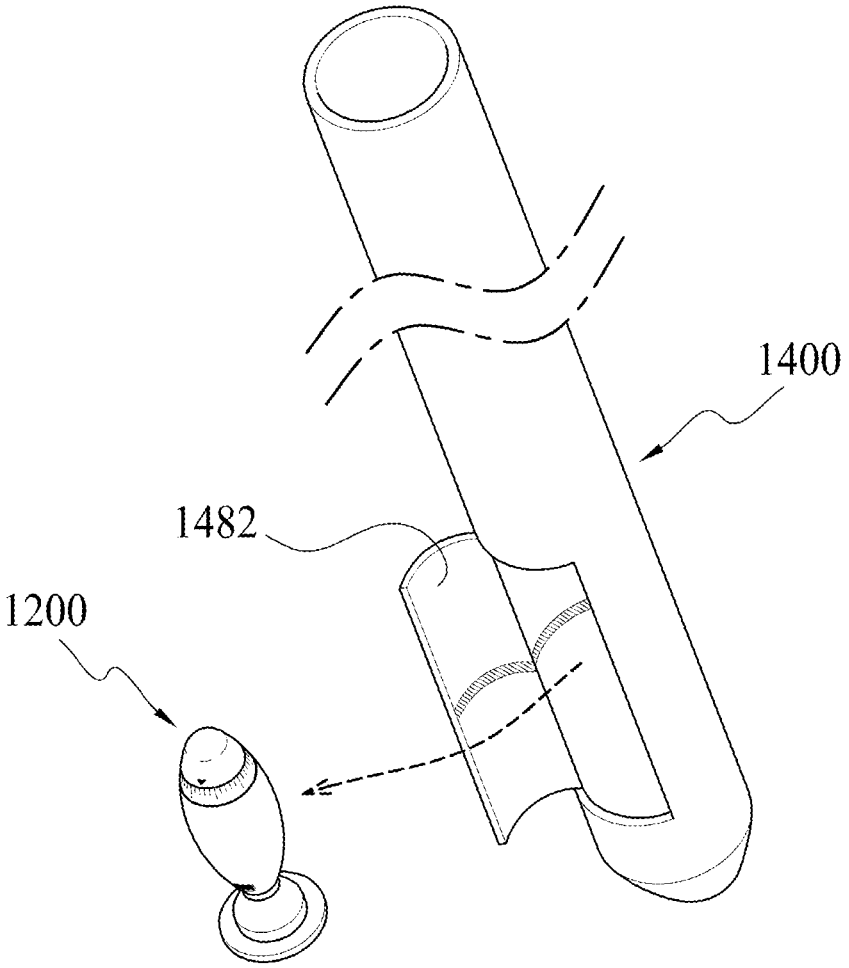
Figure 11:
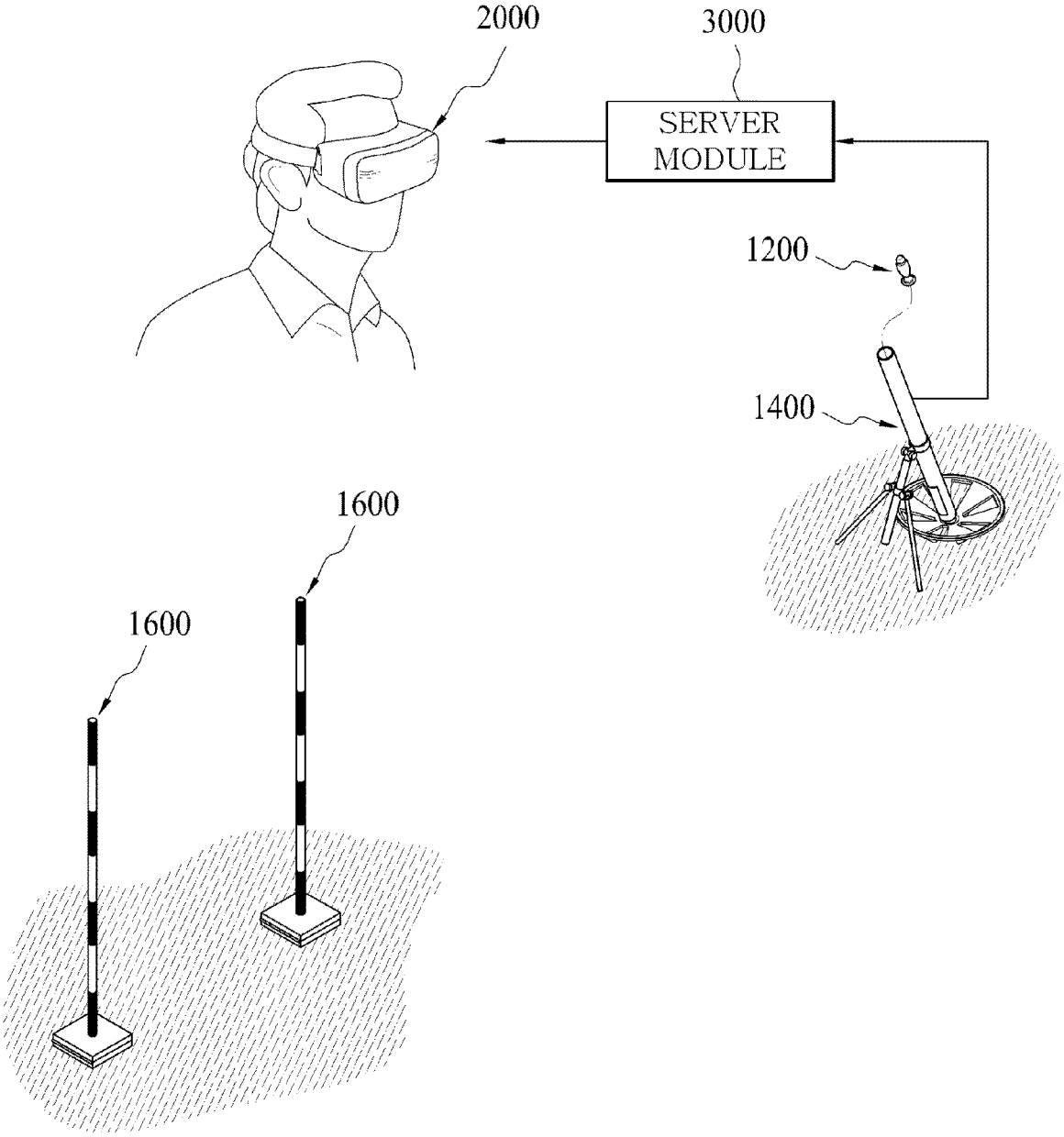

FIG. 1 is a diagram illustrating an overall shell simulated shooting simulation system according to an embodiment of the present invention;

FIG. 2 is a diagram illustrating a server module of a shell simulated shooting simulation system according to an embodiment of the present invention;

FIG. 3 is a diagram illustrating a display module of a shell simulated shooting simulation system according to an embodiment of the present invention;

FIG. 4 is a diagram illustrating an placement status of a shell simulated shooting simulation system according to an embodiment of the present invention;

FIG. 5 is a diagram illustrating an installation situation of a target unit of a shell simulated shooting simulation system according to an embodiment of the present invention;

FIG. 6 is a diagram illustrating a type of shell unit, the amount of explosives, and a control situation of the amount of fuse insertion in a shell simulated shooting simulation system according to an embodiment of the present invention;

FIG. 7 is a diagram illustrating an explosive amount adjust situation of a shell simulated shooting simulation system according to an embodiment of the present invention;

FIG. 8 is a diagram illustrating an explosive amount adjust situation of a shell simulated shooting simulation system according to another embodiment of the present invention;

FIG. 9 is a diagram illustrating a training situation of a shell simulated shooting simulation system according to an embodiment of the present invention;

FIG. 10 is a diagram illustrating a state after finishing training of a shell simulated shooting simulation system according to an embodiment of the present invention; and FIG. 11 is a diagram illustrating a display module of a shell simulated shooting simulation system according to another embodiment of the present invention.

DETAILED DESCRIPTION

Hereinafter, embodiments of the present invention, in which the object of the present invention may be realized in detail, will be described with reference to the attached drawings.

In describing the present embodiment, like names and like symbols are used for the same components, and additional descriptions thereof will be omitted.

First, a configuration of the present invention is described with reference to FIGS. 1 to 3.

Specifically, FIG. 1 is a diagram illustrating an overall shell simulated shooting simulation system according to an embodiment of the present invention, FIG. 2 is a diagram illustrating a server module of a shell simulated shooting simulation system according to an embodiment of the present invention, and FIG. 3 is a diagram illustrating a display module of a shell simulated shooting simulation system according to an embodiment of the present invention.

First, as shown in FIG. 1, a shell simulated shooting simulation system for performing a shell simulated shooting similar to a live shell shooting includes an execution module 1000 loading and aiming a shell to perform a shell simulated shooting, a display module 2000 visually displaying shooting of a shell according to loading and aiming through the execution module 1000, and a server module 3000 collecting information to visually display a result of the live shell shooting on the display module 2000 based on the information on the loading and aiming of the shell of the execution module 1000.

Here, the execution module 1000 may include a shell unit 1200 formed to adjust a type, flight distance, and time of the shell for simulated shooting, a gun barrel unit 1400 having an internal space into which the shell unit 1200 is inserted to perform a simulated shooting similar to a live shooting and recognizing the type, flight distance, and time of the shell unit 1200 inserted therein, and a target unit 1600 disposed in a position spaced apart from the gun barrel unit 1400 to form a reference point for deflection angle in a left-right direction of the gun barrel unit 1400.

Here, the shell unit 1200 may input the type of shell, the flight distance of the shell, and the rupture time of the shell to perform a shell simulated shooting, and the gun barrel unit 1400 may not actually fire the shell unit 1200 but may generate an explosion sound at a timing of shooting the shell unit 1200 to provide an environment similar to live shooting.

In addition, the target unit 1600 may form a reference in the process of placing the gun barrel unit 1400, which will be described in detail through the drawings described below.

Meanwhile, the display module 2000 may perform an actual gun placement training through the execution module 1000 and may identify the result of shooting through the display module 2000.

In addition, the display module 2000 may basically provide a first-person perspective, which may be to provide a screen similar to an actual training screen.

Here, the provision of the first-person perspective by the display module 2000 may refer to a first-person view that may be checked through devices, such as VR or AR, but when the display module 2000 is provided as a screen, a soldier who shoot the shell cannot identify an actual landing point of the shell in live shell shooting in most cases, and therefore, based thereon, the scene of the shell unit 1200 being fired may be provided from a first-person perspective and an indirect but realistic shooting-like environment may be provided in a state in which the shell unit 1200 moves away from the screen provided in the display module 2000.

In other words, basically, in the case of providing a screen through a golf screen, such as in screen golf, when a golf ball hits the screen, visual information is provided as if it is moving together with the screen to a position at which the golf ball falls, while moving along the golf ball on the screen due to various factors, such as a hitting speed or amount of impact, but in the present invention, it does not move along the shell unit 1200, but provides a first-person perspective based on the space itself where the display module 2000 is located, thereby providing an environment similar to one in which the shell unit 1200 is actually fired.

To this end, the display module 2000 provides a visual environment as if the display module 200 does not exist through a separate camera module for capturing a rear side in which the display module 2000 provides visual information, that is, a screen that the user who views the screen cannot view is covered by the display module 200, in addition to a camera module for recognizing the execution module 1000, and when simulated shooting is performed through the execution module, the display module 2000 may distinguishably reflect information that may be reflected through the camera module and information that is not reflected through the camera module.

For example, when the shell unit 1200 moves via the screen captured by the camera module during shooting, an image of the shell unit 1200 via the display module 2000 may appear, but the image of the shell unit 1200 may not appear on the display module 2000 if the screen is outside the screen captured by the camera module.

Meanwhile, the server module 3000 may check the gun placement status information through the execution module 1000, compare it with preset terrain information, and transmit the deflection angle and the elevation angle at which the shell is shot to the display module 2000 to provide visual information to the display module 2000.

More specifically, the server module 3000 may receive information transferred from the execution module 1000, sense environment information to provide an environment similar to a live shooting, and correct the sensed environment information with the information of the execution module 1000 to visually provide information through the display module 2000, and may provide visual information similar to the actual environment to the display module 2000 through an illuminance sensor.

Meanwhile, before describing the present invention in more detail, an overview of basic shell shooting training will be described. In the process of placing a gun barrel, that is, installing the gun barrel, the gun barrel may not be placed based on a basic 360 degrees, but may rather be placed according to 6400 mils using a mil unit which indicates 360 degrees as 6400, and a gun placement range may be corrected within 800 mils in the left-right direction according to a reference of shooting direction.

In addition, since the position where the gun barrel unit 1400 is placed is previously set based on a shooting direction, the gun barrel unit 1400 is placed based on the preset mil, and the target unit 1600 may be installed according to the preset mil that the gun barrel unit 1400 is placed.

However, when installing only one target unit 1600, it may be difficult to accurately adjust the angle in mil unit depending on a distance between the target unit 1600 and the gun barrel unit 1400, so a pair of target units 1600 may be provided and the gun barrel unit 1400 may be placed to adjust the preset mil based on the target unit 1600 at a far distance and the target unit 1600 at a close distance.

Of course, a mortar in which the gun barrel unit 1400 may be towed by a person rather than a vehicle is easier to manage than a large gun barrel, such as a towed gun or a tank in which deflection adjustment in the left-right direction is towed by a vehicle, so that the gun barrel unit 1400 may be directly adjusted, and as described above, gun placement may be corrected each time, rather than setting the left and right deflection angles based on 800 mils, and this may vary depending on the type of the gun barrel unit 1400 for performing shell simulated shooting and may not necessarily be limited to what is described above.

However, to facilitate understanding of the present invention, rather than describing various examples individually, the description will be made based on a mortar that may be towed by a person, and the present invention may be variously applied by varying the type of the gun barrel unit 1400 as needed, and may not necessarily be limited to what is mentioned.

Meanwhile, in the case of the shell unit 1200 used to perform shell simulated shooting, the insertion amount of fuse may be adjusted to adjust the type of shell being shot, a flight distance by which the shell flies, and time at which the shell ruptures.

More specifically, as shown in FIG. 2, the shell unit 1200 may include a selection unit 1220 adjusting the type of shell, an explosive adjustment unit 1240 adjusting the insertion amount of explosives to adjust the flight distance of the shell, and a fuse insertion unit 1260 adjusting the insertion amount of fuse to adjust a rupture time of the shell.

Here, the selection unit 1220 may be provided in plural numbers to select the type of shell for performing simulated shooting, and each may be provided with a different pattern and code depending on the type of shell, and the selection unit 1220 may be provided on the periphery of the shell unit 1200 and may be detachably provided on the shell unit 1200.

More specifically, the selection unit 1220 may select various types of shells, such as flares that rupture in the air and slowly descend toward the ground to provide light at night, white phosphorus bombs that rupture in the air and scatter a large number of white phosphorus to annihilate multiple enemies in a large space, etc. in addition to general shells for direct enemy shooting, and this is because the direction of training varies depending on the type of shells in simulated shooting training of shells, and since only one type of shell is not shot generally, it is essential to select the type of shell.

Meanwhile, the explosive adjustment unit 1240, which adjusts the amount of explosives to adjust a flight distance of the shell, may set the flight distance according to the insertion amount of explosives, and may provide a weight similar to an actual shell to provide an environment similar to live shooting.

Specifically, the explosive adjustment unit 1240 may be formed below the shell unit 1200 and may include a space member 1242 that forms a space therein, an explosive member 1244 inserted into the space member 1242 to adjust the flight distance of the shell and provided to have the same weight as the actual explosive weight, and an opening and closing member 1246 provided to open and close the space member 1242.

Here, the explosive member 1244 is set equal to the actual weight of the explosive because in a live shooting situation, the shell has a relatively heavy weight, and training by simply making it lighter may improve familiarity with the process but may cause a problem due to the weight in actual shooting situations, and therefore, the explosive member 1244 may be provided to be similar to the weight according to the actual amount of explosives so that the weight according to the amount of explosives may be felt.

Meanwhile, the fuse insertion unit 1260 may be rotatably provided around the shell unit 1200, so that time for the shell to rupture may be set according to a rotation angle, and as described above, in the case of a shell that is ruptured in the air, the insertion amount of the fuse should be adjusted so that it is ruptured in the air, so the fuse insertion unit 1260 may be provided to be set according to the type of shell by the selection unit 1220.

In addition, since the fuse insertion unit 1260 may not be used in shooting general shells, if it is not t rotated from a reference point, it may be recognized that the fuse is not inserted into the fuse insertion unit 1260, and if the fuse insertion unit 1260 is rotated, the amount of fuse insertion may be adjusted according to the rotated angle.

Accordingly, the information of the selection unit 1220, the explosive adjustment unit 1240, and the fuse insertion unit 1260 may be transferred to the server module 3000 as it is determined, and based on this, the display module 2000 may provide visual information similar to a realistic environment.

Meanwhile, the gun barrel unit 1400 may have a space formed on the inside similar to an actual gun barrel to allow the shell unit 1200 to be inserted, may include a type recognition unit 1420 for recognizing the type of shell through the selection unit 1220, a flight distance recognition unit 1440 for recognizing a flight distance of a shell by measuring the amount of explosives through the explosive adjustment unit 1240, and a fuse recognition unit 1460 for identifying a rotation angle of the fuse recognition unit 1260, and may include a main body 1480 constituting the exterior of the gun barrel unit 1400 and a door member 1482 provided to open and close the inside of the main body 1480.

Here, because it is difficult for the type recognition unit 1420 to predict in advance the angle at which the shell unit 1200 is inserted or to always insert the shell unit 1200 at the same angle, the type recognition unit 1420 may be formed in a position corresponding to the selection unit 1220 along an inner circumference of the main body 1480 to recognize the selection unit 1220.

In addition, the fuse recognition unit 1460 may also be provided along the inner circumference of the main body 1480 in a position corresponding to the fuse insertion unit 1260, and a reference point formed on the fuse recognition unit 1460 may be recognized and the insertion amount of fuse may be recognized by recognizing a rotation angle of the fuse insertion unit 1260 based on the reference point.

Meanwhile, in the case of the flight distance recognition unit 1440, since the shell unit 1200 has a weight similar to an actual shell through the explosive member 1244 for practical training, the flight distance recognition unit 1440 may recognize a flight distance by measuring the weight of the shell unit 1200 and measuring the weight of the explosive member 1244 inserted in the shell unit 1200.

Accordingly, it is possible to provide training to load and shoot a shell and check the results after shooting the shell in an environment similar to actual training by recognizing the type, flight distance, and rupture time of the shell.

In addition, as described above, the gun barrel unit 1400 may include a shell information unit transferring information of the selection unit 1220, the explosive adjustment unit 1240, and the fuse insertion unit 1260 in the server module 3000 so that the server module 3000 may provide more accurate visual information, and the server module 3000 may receive the information of the shell information unit and use the information as the gun placement status information, correct the information of the shell information unit together with environment information, and transfer the visual information to the display module 2000.

That is, the server module 3000 may recognize not only the information determined by the shell unit 1200 but also information on the elevation angle and deflection angle according to the gun placement state of the gun barrel unit 1400 and transfer the same to the display module 2000, thereby providing more accurate visual information to the display module 2000.

To summarize, practical gun displacement training may be performed through the execution module 1000, and the server module 3000 and the display module 2000 may be provided to provide results according to shooting, and there may be advantages of providing an environment more similar to a realistic shooting environment than a case of providing a first-person perspective through the display module 2000.

Meanwhile, as mentioned above, general shell shooting requires shooting considering the height of obstacles in a shooting direction, so it is important to compare preset terrain information, and wind direction, wind speed, weather, or illuminance may also be important in a real environment. Therefore, as shown in FIG. 3, the server module 3000 may determine and correct environment information and preset terrain information in addition to the gun placement status information and transmit the same to the display module 2000.

More specifically, the gun placement status information may refer to the type of shell, the insertion amount of explosives, the insertion amount of fuse, and the elevation and deflection angles of the gun barrel unit 1400, which may be adjusted through the execution module 1000 and correspond to a part that may be performed like actual training, and as mentioned above, environment information provides an environment similar to the surrounding environment by checking wind direction, wind speed, weather, and illuminance, thereby exhibiting the same effect as conducting live-shell shooting training.

Based on this, FIGS. 4 to 11 may be referred to to describe a simulated shooting situation using the present invention.

Specifically, FIG. 4 is a diagram illustrating a gun placement state of a shell simulated shooting simulation system according to an embodiment of the present invention, FIG. 5 is a diagram illustrating an installation situation of a target unit of a shell simulated shooting simulation system according to an embodiment of the present invention, FIG. 6 is a diagram illustrating a type of shell unit, the amount of explosives, and a control situation of the amount of fuse insertion in a shell simulated shooting simulation system according to an embodiment of the present invention, FIG. 7 is a diagram illustrating an explosive amount control situation of a shell simulated shooting simulation system according to an embodiment of the present invention, FIG. 8 is a diagram illustrating an explosive amount control situation of a shell simulated shooting simulation system according to another embodiment of the present invention, FIG. 9 is a diagram illustrating a training situation of a shell simulated shooting simulation system according to an embodiment of the present invention, FIG. 10 is a diagram illustrating a state after finishing training of a shell simulated shooting simulation system according to an embodiment of the present invention, and FIG. 11 is a diagram illustrating a display module of a shell simulated shooting simulation system according to another embodiment of the present invention.

First, as shown in FIG. 4, in shell shooting, the gun barrel unit 1400 may be placed based on a preset mil in a state where the preset mil is provided, and when the gun barrel unit 1400 is placed, at least one target unit 1600 may be installed so that a reference point according to shaking later may be quickly reset.

In this regard, as described above, when using the single target unit 1600, there may be a difference in the recognized distance depending on the remote distance, so the preset mil may be adjusted more accurately by using a pair of target units 1600.

In addition, in the case of shell shooting, the deflection angle in the left-right direction may be adjusted based on the preset mil, and a mil to rotate to the left or right may be selected based on the preset mil and may rotate in the left-right direction based on the target unit 1600 to aim a target.

This may be based on the target unit 1600, but since most shells are shot without the enemy being visible in the field of view, it is essential to set a reference using the target unit 1600.

In addition, it is possible to correct the visual information to be provided to the display module 2000 by recognizing the left and right angles of the gun barrel unit 1400, that is, deflection angle and elevation angle information, and the deflection angle and elevation angle may be determined according to whether a shell being shot at an obstacle or being shot at an elevation angle beyond an obstacle based on preset terrain information to visually provide information.

To this end, a process of installing the target unit 1600 is required, and as shown in FIG. 5, the preset mil may be set based on the target unit 1600 in the process of placing the gun barrel unit 1400, the target unit 1600 may be installed to re-place the preset mil even if the gun barrel unit 1400 is shaken, and may include a reference unit 1640 that provides a reference to hold the reference point in the gun barrel unit 1400 and an angle adjustment unit 1620 that maintains the reference unit 1640 in an upright position at all times by matching the reference unit 1640 to a slope of the ground in order to prevent the reference unit 1640 from being tilted according to a slope.

Here, referring to the angle adjustment unit 1620 in more detail, generally, the target unit 1600 is fixed by driving a lower portion into the ground to form a reference. If the ground is excessively curved or inclined, it may be difficult for the target to be positioned upright, and thus, the angle adjustment unit 1620 may be provided at the lower portion of the target unit 1600 to maintain the reference unit 1640 in an upright position.

More specifically, when the ground is curved or inclined as shown in FIG. 5, the angle adjustment unit 1620 may include a fixing member 1622 is that vertically coupled to the reference unit 1640, a standing member 1624 that is tilted to correspond to the angle of the ground and is in contact with the ground so that the reference unit 1640 stands upright, and a support member 1626 that supports the reference unit 1640 to maintain an upright state by maintaining an angle between the fixing member 1622 and the standing member 1624 between the fixing member 1622 and the standing member 1624.

That is, in a state in which the support member 1626 is tilted based on the fixing member 1622 to come into contact with the ground and the support member 1622 and the fixing member 1622 and the reference unit 1640 are maintained in an upright state, the angle of the fixing member 1622 and the support member 1626 may be maintained through the support member 1626, thereby easily fixing and supporting the target unit 1600.

Meanwhile, when the gun barrel unit 1400 is placed, as shown in FIG. 6, the selection unit 1220 is replaced according to the type of shell to select the type of shell according to shell simulated shooting, and a flight distance of the shell is set by inserting the explosive member 1244 according to the flight distance of the shell, and if the shell is a shell that ruptures mid-air or is delayed to rupture, the rupture time of the shell may be adjusted through the fuse insertion unit 1260.

Here, the explosive member 1244 may have a weight to provide realistic weight by providing a realistic sense of weight as described above, and as shown in FIG. 7, an actual shell insertion process may be performed by inserting the explosive member 1244 into the space member 1242.

Meanwhile, as shown in FIG. 8, no separate space is provided inside the shell unit 1200, and the space member 1242 similar to the shape of a groove is formed along the lower circumference of the shell unit 1200. In addition, the explosive member 1244 required for shooting may also be used by inserting it into the space member 1242.

This may be to prevent the training process from becoming cumbersome and prevent the meaning of the experience from fading as the process of inserting the explosive member 1244 becomes cumbersome. The explosive member 1244 may have the same weight as the actual one, but in the case where it is inserted into the space member 1242, the flight distance of the shell may be determined by the flight distance recognition unit 1440 depending on the type of the explosive member 1244 that is inserted.

In this way, after setting the type, flight distance, and rupture time of the shell for the shell unit 1200, when the shell unit 1200 is loaded inside the gun barrel unit 1400 as shown in FIG. 9, the type of shell may be recognized through the type recognition unit 1420, the amount of explosives may be measured through the flight distance recognition unit 1440, and the insertion amount of fuse may be identified through the fuse recognition unit 1460 inside the main body 1480.

However, here, since the weight of the shell unit 1200 recognized by the flight distance recognition unit 1440 may vary depending on the elevation angle of the gun barrel unit 1400 in an up-down direction, the flight distance recognition unit 1440 may include a tilt sensor and measure the flight distance by performing correction according to a slope.

As described above, when the shell unit 1200 is loaded and the gun barrel unit 1400 recognizes the information of the shell unit 1200, an action may be taken to shoot the shell as in live shooting. In order to provide an environment similar to live shooting, the gun barrel unit 1400 may generate a sound as if the shell unit 1200 has been fired.

That is, in a state in which the shell unit 1200 is positioned inside the gun barrel unit 1400, only sound is generated from the gun barrel unit 1400, so that shell simulated shooting may be performed in a similar environment to an actual shooting without firing the shell unit 1200 to the outside, and as a result, it is possible to effectively solve limitations in performing shell simulated shooting due to accidents where simulated shells fall into private houses or environmental factors.

In addition, since the server module 3000 receives information on the selection unit 1220, the explosive adjustment unit 1240, and the fuse insertion amount through the shell information unit, the server module 3000 may determine a shooting distance of the shell and the rupture position of the shell according to the selection unit 1220, the explosive adjustment unit 1240, and the insertion amount of fuse and provide shooting results, while providing visual information, such as actual shooting, along with the elevation and deflection angles of the gun barrel unit 1400.

In addition, the server module 3000 may receive information on a deflection angle of the gun barrel unit 1400 from a deflection angle adjustment unit for adjusting a deflection angle based on the target unit 1600 separately provided in the gun barrel unit 1400 and information from an elevation angle adjustment unit that adjusts a flight distance according to an altitude at which a shell is shot or adjusts an elevation angle for preventing shooting at obstacles, and may visually recognize information of the deflection angle and the elevation angle of the gun barrel unit 1400 based on one end portion of the gun barrel unit 1400 but is not limited thereto.

Meanwhile, as shown in FIG. 10, after performing training in which the shell unit 1200 is fired through shell simulated shooting, the shell unit 1200 located inside the gun barrel unit 1400 may be released through the door member 1482 to re-perform the above process.

In other words, as mentioned in the present invention, the shell unit 1200 is not actually fired, but the actual environment, such as the actual weight of the gun barrel, weight of the shell, type of shell, flight distance of the shell, setting the insertion amount of fuse, loading of the shell, etc. may be similarly provided, and since no actual shells are fired, there may be an advantage in that training may be conducted without restrictions on location and environment.

Meanwhile, as shown in FIG. 11, the display module 2000 may have the form of the screen described above, but may also be provided in VR or AR to provide a realistic experience during the training process. Since the purpose is to indirectly experience the actual environment as if it were real rather than based on the shell through the shell unit 1200 of the execution module 1000, the display module 2000 provides a first-person view based on the gun barrel unit 1400 as a basis, and after indirectly identifying the visual information on the live shell shooting through the first-person view, a point of hitting of the shell may be checked if necessary.

Alternatively, the display module 2000 may be provided in plurality to provide a screen that may be checked by a user performing placement of a gun barrel and a different screen based on an observation soldier observing the point of shooting of a shell, but is necessarily limited thereto.

Embodiments according to the invention have been described, and it is obvious to those skilled in the art that the present invention may be embodied in other specific forms without departing from its spirit or scope, in addition to the embodiments described above.

Therefore, the aforementioned embodiments are to be regarded as illustrative and not restrictive, and accordingly, the present invention is not limited to the above description but may be modified within the scope of the appended claims and their equivalents.

What is claimed is:

1. A shell simulated shooting simulation system for performing shell simulated shooting, the shell simulated shooting simulation system comprising:

a shell comprising: a fuse marker adjusting a time for the shell to rupture and a shell selection marker configured to provide information on a type of the shell, wherein the shell selection marker is provided on a periphery of the shell or is detachably provided on the shell;

an explosive placed in a cavity of the shell;

a gun barrel configured to accommodate the shell, the gun barrel comprising: a fuse reader configured to read the rupture time information from the fuse marker; a shell selection reader configured to read the shell type information from the shell selection marker; and a weight calculator configured to measure the weight of the shell when the gun barrel receives the shell;

a target configured to form a reference point for a deflection angle of the gun barrel;

a display configured to visually display an action of aiming and shooting of the shell; and a server configured to calculate a flight distance and a rupture location of the shell based on the shell type information and the rupture time information and transfers the calculated results to the display.

2. The shell simulated shooting simulation system of claim 1, wherein the shell further includes:

an adjuster of the explosive adjusting an amount of the explosives inserted into the shell to adjust the flight distance of the simulated shooting shell.

3. The shell simulated shooting simulation system of claim 1, wherein the server further receives gun placement status information of the gun barrel, compares the gun placement placemen status information with preset terrain information, and transfers the deflection angle and an elevation angle at which the shell is shot to the display.

4. The shell simulated shooting simulation system of claim 3, wherein the gun barrel includes:

a deflection angle controller adjusting the deflection angle based on the target unit; and an elevation angle controller adjusting the flight distance according to an altitude at which the shell is shot or adjusting the elevation angle to prevent the shell from being shot at an obstacle.

5. The shell simulated shooting simulation system of claim 1, wherein the display displays and provides a shell simulated shooting environment based on a first-person perspective.

6. The shell simulated shooting simulation system of claim 1, wherein the server includes an illuminance sensor configured to adjust illuminance of the display.

* * * * *